US010943724B1

(12) United States Patent
Folker et al.

(10) Patent No.: US 10,943,724 B1
(45) Date of Patent: Mar. 9, 2021

(54) MAGNETIC CORE STRUCTURE

(71) Applicant: Universal Lighting Technologies, Inc., Madison, AL (US)

(72) Inventors: Donald Folker, Madison, AL (US); Mike LeBlanc, Huntsville, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 284 days.

(21) Appl. No.: 15/887,421

(22) Filed: Feb. 2, 2018

Related U.S. Application Data

(60) Provisional application No. 62/455,152, filed on Feb. 6, 2017.

(51) Int. Cl.

| | |
|---|---|
| ***H01F 27/24*** | (2006.01) |
| ***H01F 27/30*** | (2006.01) |
| ***H01F 41/02*** | (2006.01) |
| ***H01F 27/32*** | (2006.01) |

(52) U.S. Cl.
CPC ..... *H01F 27/24* (2013.01); *H01F 27/306* (2013.01); *H01F 27/325* (2013.01); *H01F 41/02* (2013.01)

(58) Field of Classification Search
CPC ..... H01F 27/325; H01F 27/29; H01F 27/24; H01F 27/324; H01F 27/266; H01F 27/2823; H01F 2027/297; H01F 5/02; H01F 2005/022; H01F 2005/046; H01F 27/292
USPC ..... 336/178, 192, 196, 198, 208, 212, 221
See application file for complete search history.

(56) References Cited

U.S. PATENT DOCUMENTS

| | | | | |
|---|---|---|---|---|
| 2,494,180 | A * | 1/1950 | Koubek | H01F 27/245 336/100 |
| 5,685,065 | A * | 11/1997 | Suzuki | H01F 38/12 123/634 |
| 5,726,616 | A * | 3/1998 | Bell | H01F 27/266 336/192 |
| 9,799,442 | B1 | 10/2017 | Folker et al. | |
| 9,842,683 | B1 | 12/2017 | LeBlanc et al. | |

(Continued)

FOREIGN PATENT DOCUMENTS

| | | | |
|---|---|---|---|
| JP | 07230919 | A * | 8/1995 |
| JP | 2004207581 | A * | 7/2004 |

(Continued)

*Primary Examiner* — Tszfung J Chan
(74) *Attorney, Agent, or Firm* — Patterson Intellectual Property Law, P.C.; Gary L. Montle; Jerry Turner Sewell

(57) ABSTRACT

A magnetic assembly structure includes a bobbin, an outer core, an inner core, and a gap spacer. The bobbin has first and second flanges. The bobbin has a passageway extending between the first and second flanges. The passageway has at least one crushable passageway rib and a channel wall parallel to the second flange. The outer core is positioned around the first and second flanges. The outer core includes an opening positioned near the first flange. The inner core is positioned in the opening and in the passageway. The gap spacer is positioned between the inner core and an inner surface of the outer core. The gap spacer and outer core are held in frictional engagement between the inner core and channel wall. The gap spacer defines a gap distance which is adjustable by replacing the gap spacer with one of having a different thickness. Adjusting the gap distance modifies the inductance.

15 Claims, 10 Drawing Sheets

(56) References Cited

U.S. PATENT DOCUMENTS

| | | | | |
|---|---|---|---|---|
| 2002/0021202 | A1* | 2/2002 | Yeh | H01F 21/065<br>336/200 |
| 2003/0080844 | A1* | 5/2003 | Nishikawa | H01F 3/14<br>336/178 |
| 2004/0036568 | A1* | 2/2004 | Suzuki | H01F 27/022<br>336/192 |
| 2014/0159852 | A1* | 6/2014 | Miura | H01F 27/02<br>336/208 |

FOREIGN PATENT DOCUMENTS

| | | | | |
|---|---|---|---|---|
| JP | 2008171964 | A | * | 7/2008 |
| JP | 2016100540 | A | * | 5/2016 |

* cited by examiner

MAGNETIC CORE STRUCTURE

CROSS-REFERENCES TO RELATED APPLICATIONS

This application claims benefit of the following patent application which is hereby incorporated by reference: U.S. Provisional Patent Application No. 62/455,152 filed Feb. 6, 2017, entitled "Magnetic Core Structure."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to magnetic assembly structures. More particularly, the present disclosure relates to a new magnetic assembly structure and a method of assembling.

BACKGROUND OF THE INVENTION

Currently, magnetic assemblies are made with two "E" shaped cores, with the center leg of each core inserted into a bobbin from respective ends of the bobbin. The exposed end of the center leg of each "E" core is ground to reduce the length of the center leg with respect to the outer legs of the core. Thus, when the mating ends of the outer legs of the two cores meet outside the bobbin, the mating ends of the center legs are offset by a small amount to create a gap between the cores approximately at the center of the bobbin. The size of the gap directly relates to the inductance of the magnetic assembly. A smaller gap corresponds to a larger inductance, while a larger gap corresponds to a smaller inductance. The center leg gap is located directly below the center of the winding. The stray field from the gap creates loss in the winding. The cores must be glued or taped together. The "E" structure has three mating surfaces, one on the center leg and two on the outer legs. It is not easy to change the inductance of this magnetic assembly. To decrease the inductance, the two "E" cores must be removed from the bobbin and a portion of the center leg ground to shorten the center leg. The two cores are inserted back into the bobbin. To increase the inductance, the two "E" cores are removed and replaced with two "E" core with a smaller air gap.

BRIEF SUMMARY OF THE INVENTION

A need exists for a magnetic assembly that has an outer core and has an inner core allowing for efficient and easy adjustment of the gap without grinding. The magnetic assembly would also benefit from positioning the gap outside of the winding area. The magnetic assembly would further benefit form eliminating the need to tape or glue the cores to the bobbin.

One embodiment disclosed herein is a new structure for a magnetic assembly. The magnetic assembly includes a bobbin, an outer core, an inner core, and a gap spacer. The bobbin has a first outer flange, a second outer flange, a passageway. The passageway extends through the bobbin from a first outer flange outer surface to a second outer flange outer surface. The bobbin further has at least one winding wound about the passageway between the first outer flange and the second outer flange. The outer core is configured to be positioned around the first outer flange and the second outer flange. The outer core has a first end wall. The first end wall of the outer core has a first inner surface. The first inner surface is configured to be positioned adjacent to the first end flange. The first end wall has an opening configured to be positioned in alignment with the passageway. The outer core further has a second end wall. The second end wall has a second inner surface. The second inner surface is configured to be positioned adjacent the second end flange. The inner core is configured to be positioned through the passageway of the bobbin. The inner core has a first end surface, a second end surface, and an outer surface. The outer surface of the inner core spans between the first end surface and the second end surface of the inner core. The first end surface of the inner core extends past the first outer flange of the bobbin and is accessible through the opening in the first end wall of the outer core. The second end surface of the inner core is configured to be positioned adjacent to the second outer flange of the bobbin. The gap spacer is configured to be positioned between the second end surface of the inner core and the second inner surface of the outer core. The gap spacer is configured to define a gap distance.

In certain embodiments, the magnetic assembly has a channel wall extending parallel to the second outer flange outer surface. The channel wall has an inner channel wall surface. The inner channel wall surface is spaced apart from the second outer flange outer surface by a channel distance that defines a channel between the second outer flange outer surface and the inner channel wall surface. The second end wall of the outer core is secured by frictional engagement between the second end surface of the inner core and the inner channel wall surface.

In certain embodiments, the bobbin of the magnetic assembly has at least one crushable passageway rib protruding into the passageway.

In certain embodiments, the inner core is configured to be in frictional engagement with the at least one crushable passageway rib.

In certain embodiments, the gap spacer is configured to be secured through frictional engagement between the second end surface of the inner core and the second inner surface of the outer core.

In certain embodiments, the gap distance is adjustable by selecting a thickness of the gap spacer.

In certain embodiments, the gap spacer is made of tape or paper.

In certain embodiments, the opening of the outer core is configured to extend to a lower surface of the outer core.

In certain embodiments, the passageway of the bobbin has a rectangular cross-sectional passageway profile having four sides and the inner core has a rectangular cross-sectional inner core profile configured to fit within the passageway. The passageway of the bobbin further includes at least four crushable passageway ribs, with at least a respective one of the ribs extending into the passageway from a respective one of the four sides of the passageway. The opening of the outer core has a rectangular opening profile configured to receive the inner core.

In certain embodiments, the passageway of the bobbin has a circular cross-sectional passageway profile and the inner core has a circular cross-sectional inner core profile configured to fit within the passageway. The passageway of the bobbin further includes at least three crushable passageway ribs. The at least three crushable passageway ribs are configured to center the inner core within the passageway. The opening of the outer core has a semicircular top opening profile and a rectangular lower opening profile.

In certain embodiments, the bobbin of the magnetic assembly has at least one intermediate flange positioned between the first outer flange and the second outer flange. The at least one winding may include a first winding and a second winding. The first winding positioned between the first outer flange and the at least one intermediate flange. The second winding positioned between the second outer flange and the at least one intermediate flange.

Another embodiment disclosed herein is a method of assembling a magnetic assembly. The method includes the step of providing a bobbin having a first outer flange, a second outer flange, and a passageway. The passageway extends through the bobbin from the first outer flange to the second outer flange. The bobbin has at least one winding wound about the bobbin between the first outer flange and the second outer flange. The bobbin has a channel wall spaced apart from and parallel to the second outer flange. The bobbin further has at least one crushable passageway rib protruding into the passageway.

The method further includes the step of positioning an outer core around the first and second outer flanges of the bobbin. The outer core has a first end wall. The first end wall has a first inner surface positioned adjacent the first outer flange. The outer core further has a second end wall. The second end wall has a second inner surface positioned near the second outer flange. The first end wall has an opening. The opening has an opening profile aligned with the passageway.

The method further includes the step of positioning a first gap spacer between the second outer flange and the second inner surface of the outer core. The first gap spacer has a first thickness.

The method further includes the step of positioning an inner core into the passageway of the bobbin. The inner core has a first end surface and a second end surface. The first end surface extends past the first outer flange and is accessible through the opening in the first end wall of the outer core. The second end surface is positioned adjacent to the second outer flange. The inner core is configured to frictionally engage the at least one crushable passageway rib protruding into the passageway.

The method further includes the step of sliding the inner core within the passageway toward the channel wall until the second end wall of the outer core and the first gap spacer are frictionally engaged between the second end surface of the inner core and an inner surface of the channel wall. The first gap spacer defines a first gap distance between the second end surface of the inner core and the second inner surface of the outer core.

In certain embodiments, the method further includes the step of sliding the inner core within the passageway away from the channel wall. The method may further include the step of replacing the first gap spacer with a second gap spacer. The second gap spacer has a second thickness. The second thickness is larger than the first thickness. The method may further include the step of sliding the inner core within the passageway toward the channel wall until the second end wall of the outer core and the second gap spacer are frictionally engaged between the second end surface of the inner core and the inner surface of the channel wall. The second gap spacer defines a second gap distance between the second end surface of the inner core and the second end wall of the outer core.

In certain embodiments, the method further includes the step of sliding the inner core within the passageway away from the channel wall. The method may further include the step of replacing the first gap spacer with a second gap spacer. The second gap spacer has a second thickness. The second thickness is smaller than the first thickness. The method may further include the step of sliding the inner core within the passageway toward the channel wall until the second end wall of the outer core and the second gap spacer are frictionally engaged between the second end surface of the inner core and the inner surface of the channel wall. The second gap spacer defines a second gap distance between the second end surface of the inner core and the second end wall of the outer core.

Numerous other objects, advantages and features of the present disclosure will be readily apparent to those of skill in the art upon a review of the following drawings and description of a preferred embodiment.

DETAILED DESCRIPTION OF THE INVENTION

Figure 1:
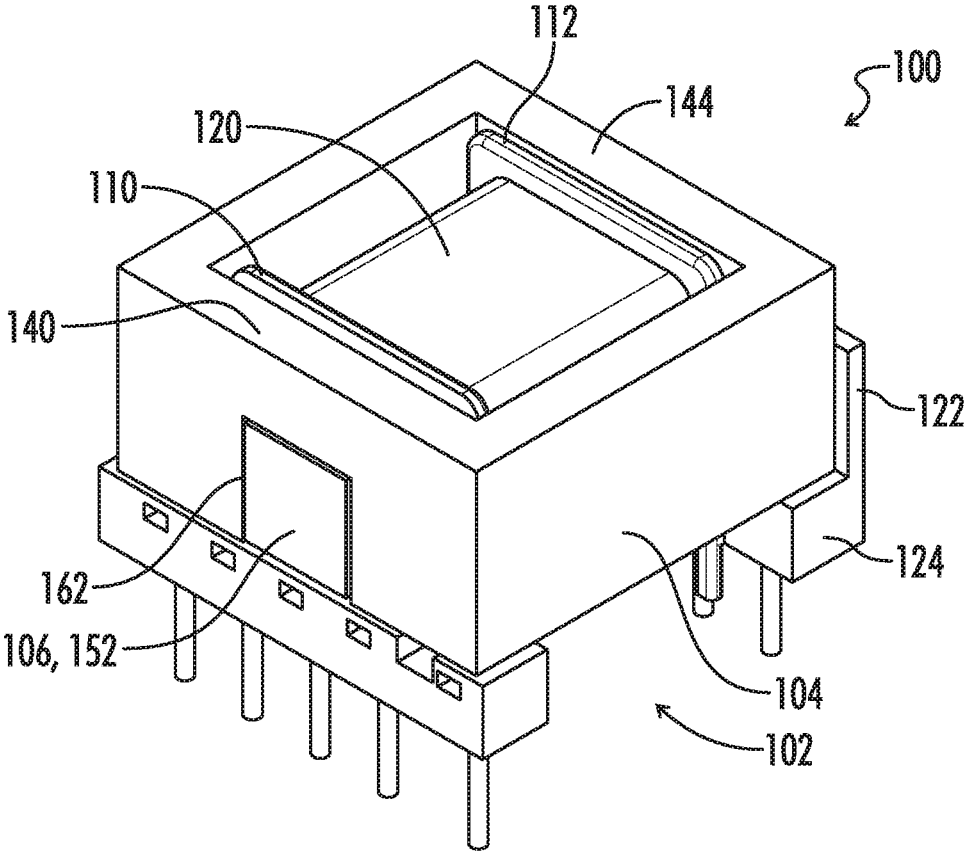
FIG. 1 illustrates a perspective view of a magnetic assembly with a rectangular center leg in accordance with the present disclosure.

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

It is intended that the present disclosure covers such modifications and variations as come within the scope of the appended claims and their equivalents. Other objects, features, and aspects of the present disclosure are disclosed in the following detailed description. It is to be understood by one of ordinary skill in the art that the present discussion is a description of exemplary embodiments only and is not intended as limiting the broader aspects of the present disclosure.

A first embodiment of a magnetic assembly 100 is shown in FIGS. 1-7. The magnetic assembly 100 may be referred to as a magnetic device 100 or a magnetic component 100. In the first embodiment, the magnetic assembly 100 includes a bobbin 102, an outer core 104, an inner core 106, and a gap spacer 108.

Figure 2:
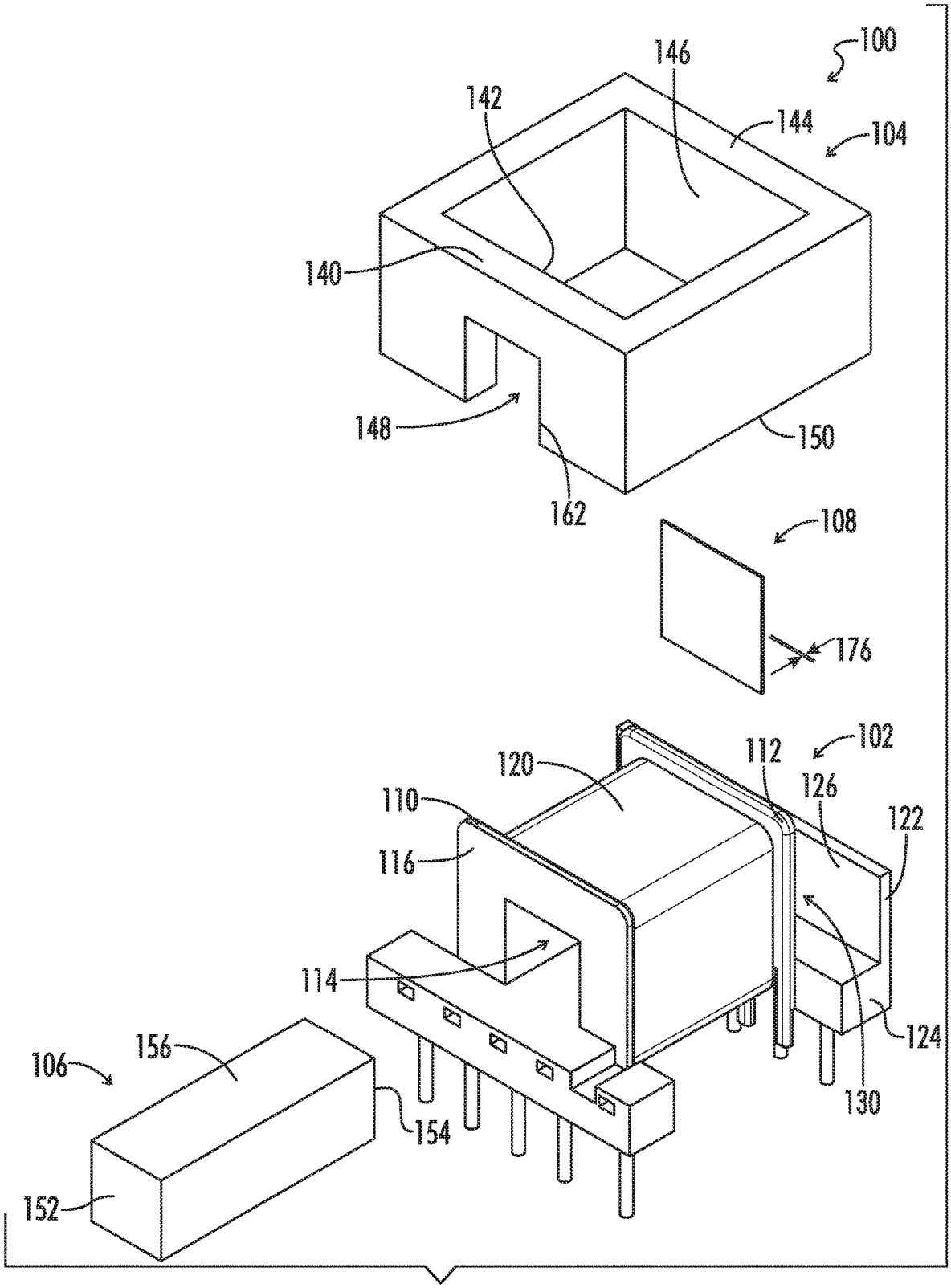
FIG. 2 illustrates an exploded perspective view of the magnetic assembly of FIG. 1.
Figure 3:
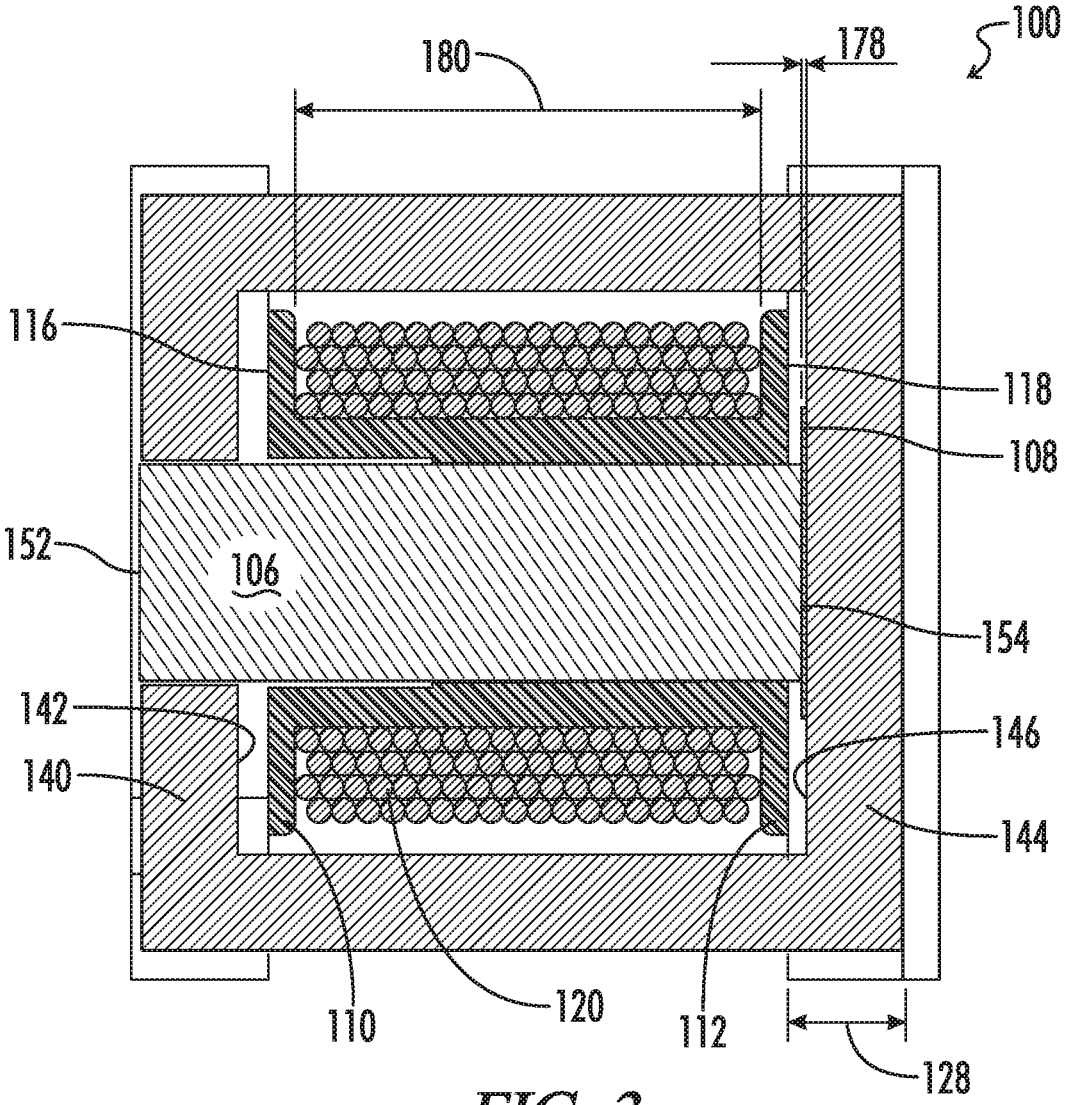
FIG. 3 illustrates a cross-sectional upper plan view of the assembly of FIG. 1.
Figure 4:
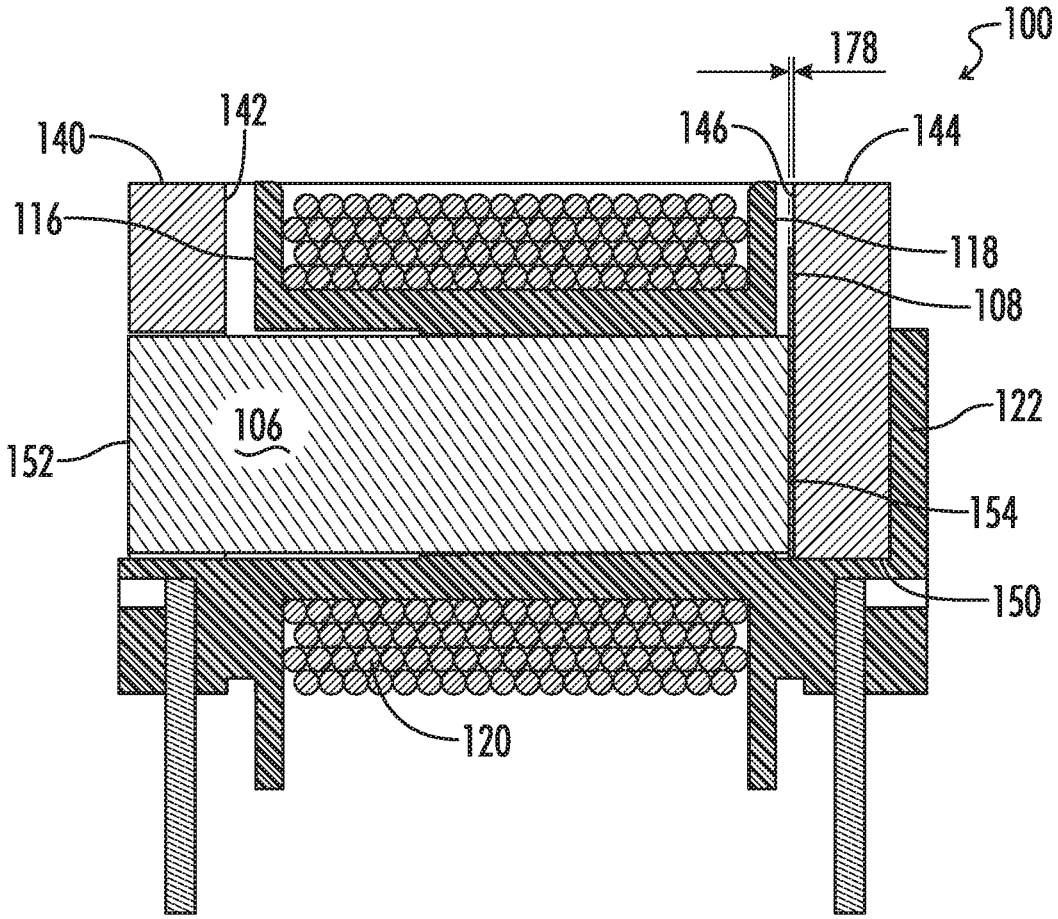
FIG. 4 illustrates a cross-sectional right side elevational view of the assembly of FIG. 1.

As shown in FIG. 2, the bobbin 102 of the magnetic assembly 100 includes a first outer flange 110, a second outer flange 112, and a passageway 114. The passageway 114 of the bobbin 102 is configured to extend through the bobbin 102 from a first outer flange outer surface 116 to a second outer flange outer surface 118 (FIGS. 3 and 4). The bobbin 102 further includes at least one winding 120 wound about the passageway 114 between the first outer flange 110 and the second outer flange 112.

In the first embodiment, the bobbin 102 further includes a channel wall 122. The channel wall 122 extends vertically from a pin rail 124 attached to the second outer flange outer surface 118. The channel wall 122 is parallel to the second outer flange outer surface 118. The channel wall 122 has an inner channel wall surface 126. The inner channel wall surface 126 is spaced apart from the second outer flange outer surface 118 by a channel distance 128 (FIG. 3). The channel distance 128 defines a channel 130 (FIG. 2) between the inner channel wall surface 126 and the second outer flange outer surface 118. In an alternative embodiment, the bobbin 102 includes at least one crushable flange rib (not shown) to position the outer core 104 with respect to the bobbin 102.

Figure 5:
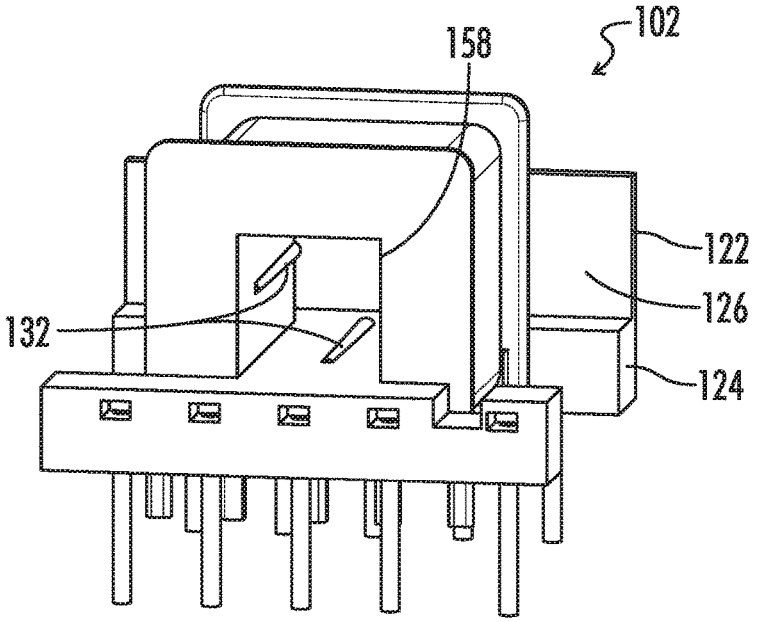
FIG. 5 illustrates a perspective view of the bobbin of FIG. 2.
Figure 6:
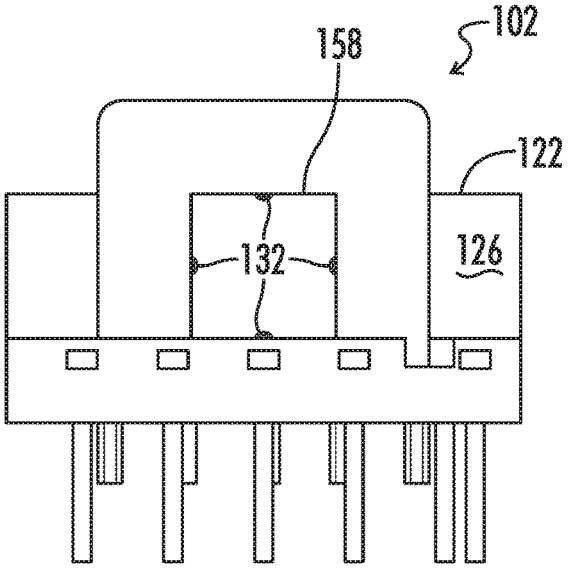
FIG. 6 illustrates a front elevational view of the front of the bobbin of FIG. 2.
Figure 7:
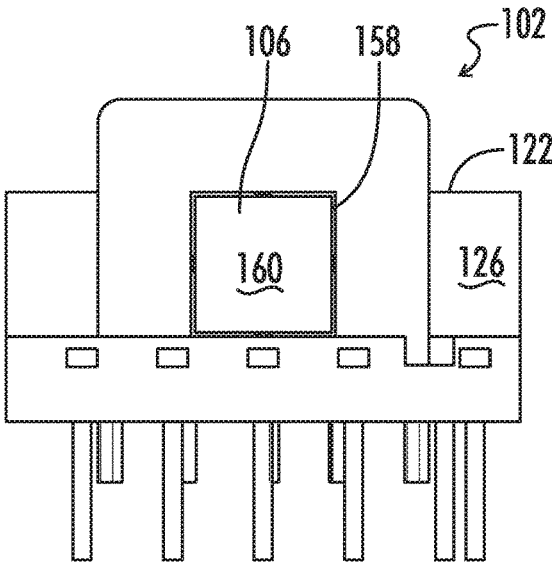
FIG. 7 illustrates the front elevational view of the bobbin of FIG. 2 with the center core inserted in the passageway of the bobbin.

As shown in FIGS. 5-7, the bobbin 102 includes at least one crushable passageway rib 132 protruding into the passageway 114.

In the first embodiment, the outer core 104 of the magnetic component 100 is configured to be positioned around the first outer flange 110 and the second outer flange 112. The outer core 104 is one continuous piece. Because the outer core 104 is one continuous piece, no stray fields are created by the outer core 104, and thus the magnetic assembly 100 may be more efficient. The outer core 104 has a first end wall 140. The first end wall 140 has a first inner surface 142, as shown in FIGS. 3 and 4. The first inner surface 142 is configured to be positioned adjacent to the first outer flange 110. The outer core 104 further has a second end wall 144. The second end wall 144 has a second inner surface 146. The second inner surface 146 is configured to be positioned adjacent to the second outer flange 112. The first end wall 140 further includes an opening 148. The opening 148 is configured to align with the passageway 114. In the illustrated embodiment, the outer core 104 comprises a ferrite material.

As shown in FIG. 2, the opening 148 of the outer core 104 is configured to extend to a lower surface 150 of the outer core 104. In certain embodiments (not shown), the opening 148 of the outer core 104 does not extend to the lower surface 150.

In the first embodiment, the inner core 106 of the magnetic assembly 100 is configured to be positioned through the passageway 114 of the bobbin 102. The inner core 106 has a first end surface 152, a second end surface 154, and an outer surface 156. The outer surface 156 of the inner core 106 spans between the first end surface 152 and the second end surface 154 of the inner core 106. The first end surface 152 of the inner core 106 extends past the first outer flange 110 of the bobbin 102. The first end surface 152 of the inner core 106 is accessible through the opening 148 in the first end wall 140 of the outer core 104 when the outer core 104 is positioned on the bobbin 102. The opening 148 of the outer core 104 provides access to the inner core 106. The second end surface 154 of the inner core 106 is configured to be positioned adjacent to the second outer flange 112 of the bobbin 102. In the illustrated embodiment, the inner core 106 comprises a ferrite material.

As shown in FIG. 7, the inner core 106 is positioned in frictional engagement with the at least one crushable passageway rib 132. The at least one crushable passageway rib 132 is shown uncrushed in FIG. 6 and is shown crushed in FIG. 7.

As shown in FIGS. 3 and 4, the second end wall 144 of the outer core 104 is configured to be received in the channel 130. The second end wall 144 of the outer core 104 is secured to the bobbin 102 by frictional engagement between the second end surface 154 of the inner core 106 and the inner channel wall surface 126 of the channel wall 122.

The passageway 114 of the bobbin 102 has a rectangular cross-sectional passageway profile 158 having four sides, as shown in FIGS. 5-7. As shown in FIG. 7, the inner core 106 has a rectangular cross-sectional inner core profile 160. The rectangular cross-sectional inner core profile 160 of the inner core 106 is configured to fit within the rectangular cross-sectional passageway profile 158 of the passageway 114. As shown in FIGS. 5 and 6, the at least one crushable passageway rib 132 includes at least four ribs, with at least a respective one of the ribs extending into the passageway 114 from a respective one of the four sides of the passageway 114. As shown in FIGS. 1 and 2, the opening 148 of the outer core 104 has a rectangular opening profile 162. The rectangular cross-sectional inner core profile 160 is configured to fit within the rectangular opening profile 162.

In the first embodiment, the gap spacer 108 of the magnetic assembly 100 is configured to be positioned between the second end surface 154 of the inner core 106 and the second inner surface 146 of the outer core 104, as shown in FIG. 2. The gap spacer 108 has a thickness 176. The gap spacer 108 is configured to define a gap distance 178 (FIGS. 3 and 4) between the second end surface 154 of the inner core 106 and the second inner surface 146 of the outer core 104. The gap distance 178 is defined even if only part of the gap spacer 108 covers the second end surface 154 of the inner core 106. The gap spacer 108 is secured to the magnetic assembly 100 through frictional engagement between the second end surface 154 of the inner core 106 and the second inner surface 146 of the outer core 104. The gap distance 178 is adjustable. The gap distance 178 may be adjusted by selecting the thickness 176 of the gap spacer. The gap spacer 108 may comprise tape, paper, or any other suitable material.

In certain embodiments (not shown), the gap distance may be adjusted by using multiple gap spacers.

As shown in FIG. 3, the gap spacer 108 is positioned outside of a winding area 180. The winding area 180 is defined between the first outer flange 110 and the second outer flange 112. The at least one winding 120 is wound onto the winding area 180. Because the gap spacer 108 is positioned outside of the winding area, the stray fields (not shown) produced by the gap do not create unwanted winding losses.

The magnetic assembly 100 is assembled by providing the bobbin 102 having the first outer flange 110, the second outer flange 112, the passageway 114, the at least one winding 120, the channel wall 122, and the at least one crushable passageway rib 132. The outer core 104 is then positioned around the first and second outer flanges 110, 114 of the bobbin 102. The gap spacer 108 is then positioned between the second outer flange 114 and the second inner surface 146 of the outer core 104. The inner core 106 is then positioned into the passageway 114 of the bobbin 102. The steps of positioning the outer core 104, gap spacer 108, and inner core 106 may be done in any order. The inner core 106 is then slid within the passageway 114 toward the channel wall 122 until the second end wall 144 of the outer core 104 and the gap spacer 108 are frictionally engaged between the second end surface 154 of the inner core 106 and the inner channel wall surface 126.

In certain embodiments (not shown), the gap distance 178 may be increased in order to decrease the inductance. In other embodiments (not shown), the gap distance 178 may be decreased in order to increase the inductance. The gap distance 178 may be adjusted by using a thicker or thinner gap spacer 108 or by selectively increasing or decreasing the number of gap spacers 108.

The frictional engagement between the bobbin 102, outer core 104, inner core 106, and gap spacer 108 eliminates the need to glue or tape the cores and/or magnetic assembly 100 together.

The inner core 106, the passageway 114, and the opening 162 may have profiles other than the illustrated rectangular profiles (e.g., circular, oval, triangular, hexagonal, or the like). For example, FIGS. 8-14 illustrate a second embodiment of a magnetic assembly 800 with circular profiles.

The magnetic assembly 800 may be referred to as a magnetic device 800 or a magnetic component 800. In the illustrated embodiment, the magnetic assembly 800 includes a bobbin 802, an outer core 804, an inner core 806, and a gap spacer 808.

Figure 9:
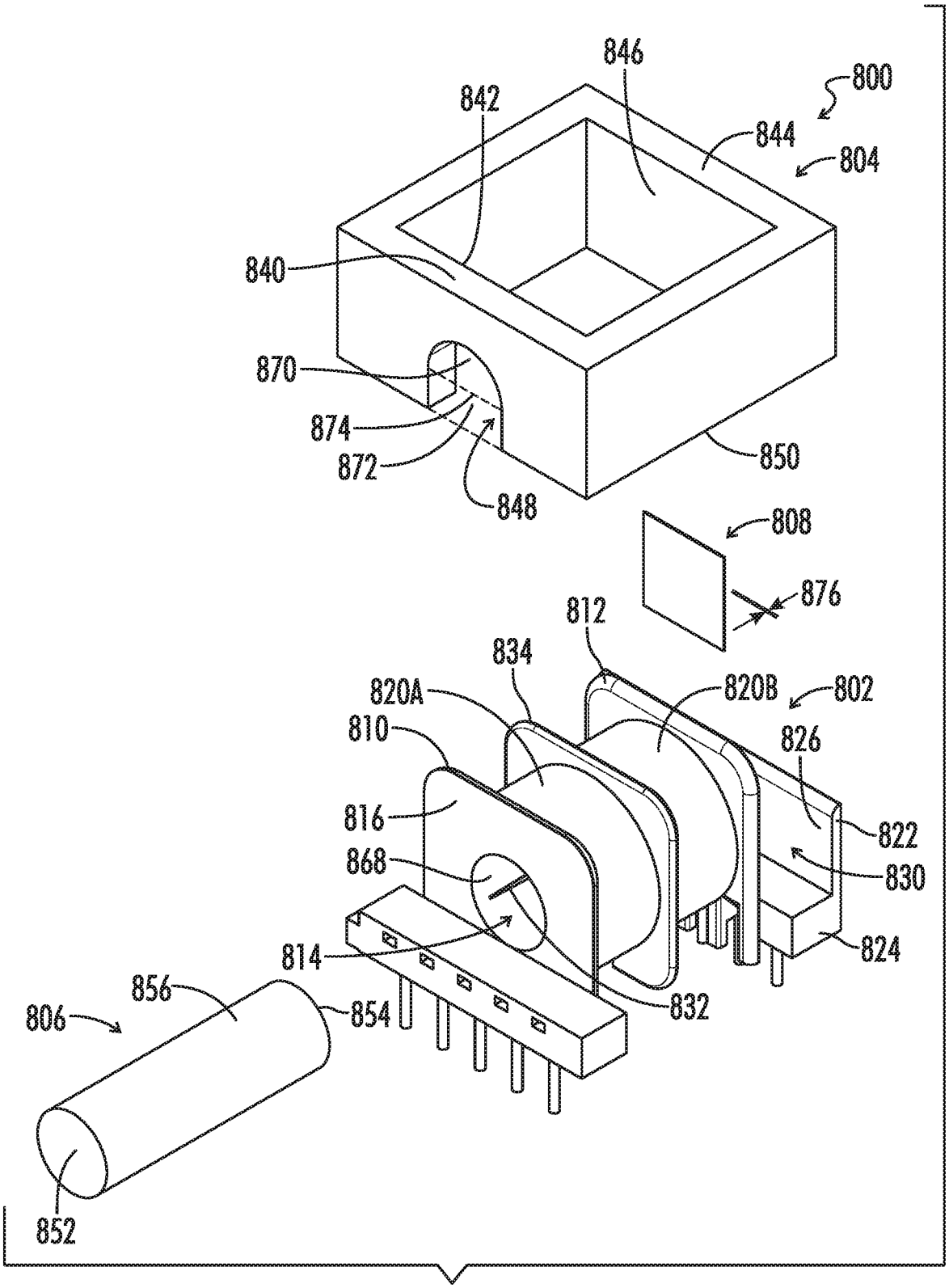
FIG. 9 illustrates an exploded perspective view of the magnetic assembly of FIG. 8.
Figure 10:
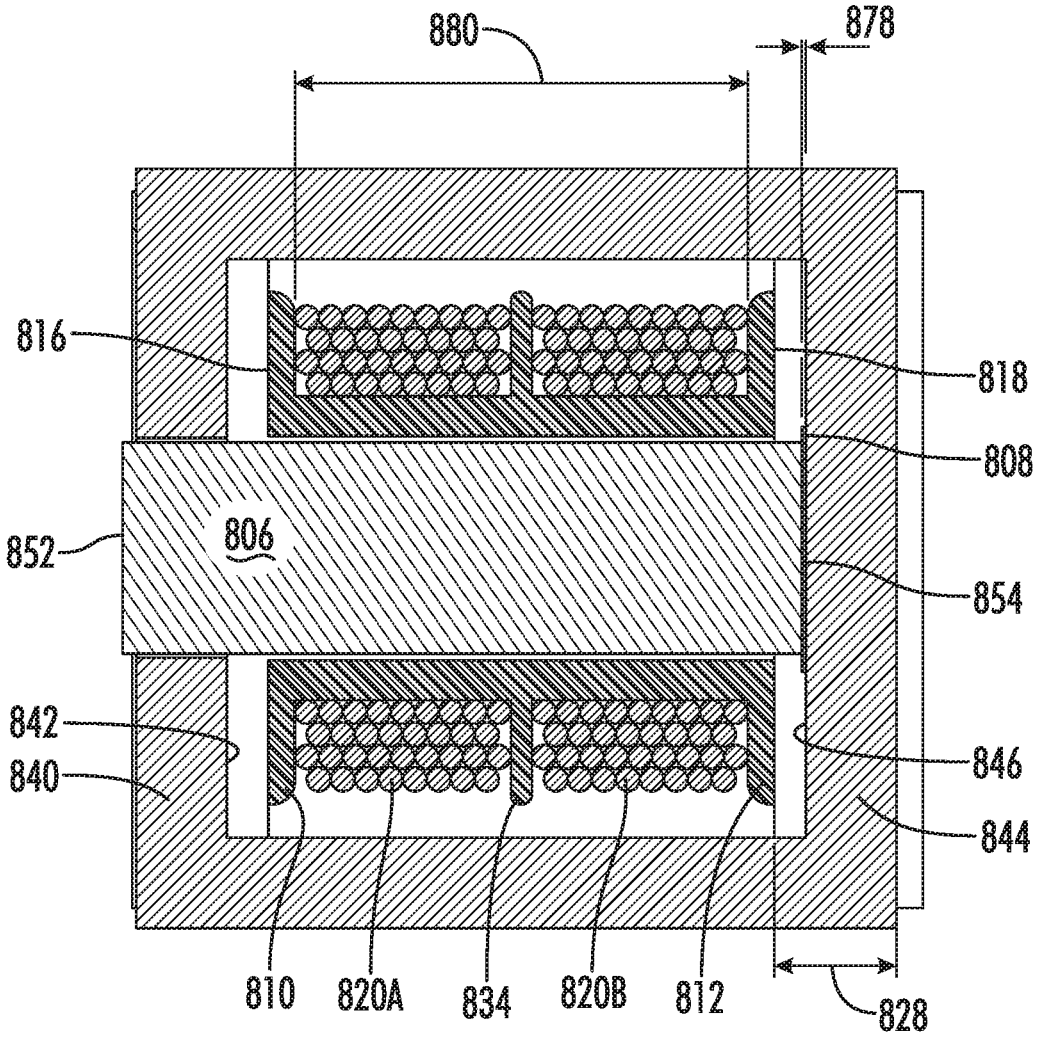
FIG. 10 illustrates a cross-sectional upper plan view of the assembly of FIG. 8.
Figure 11:
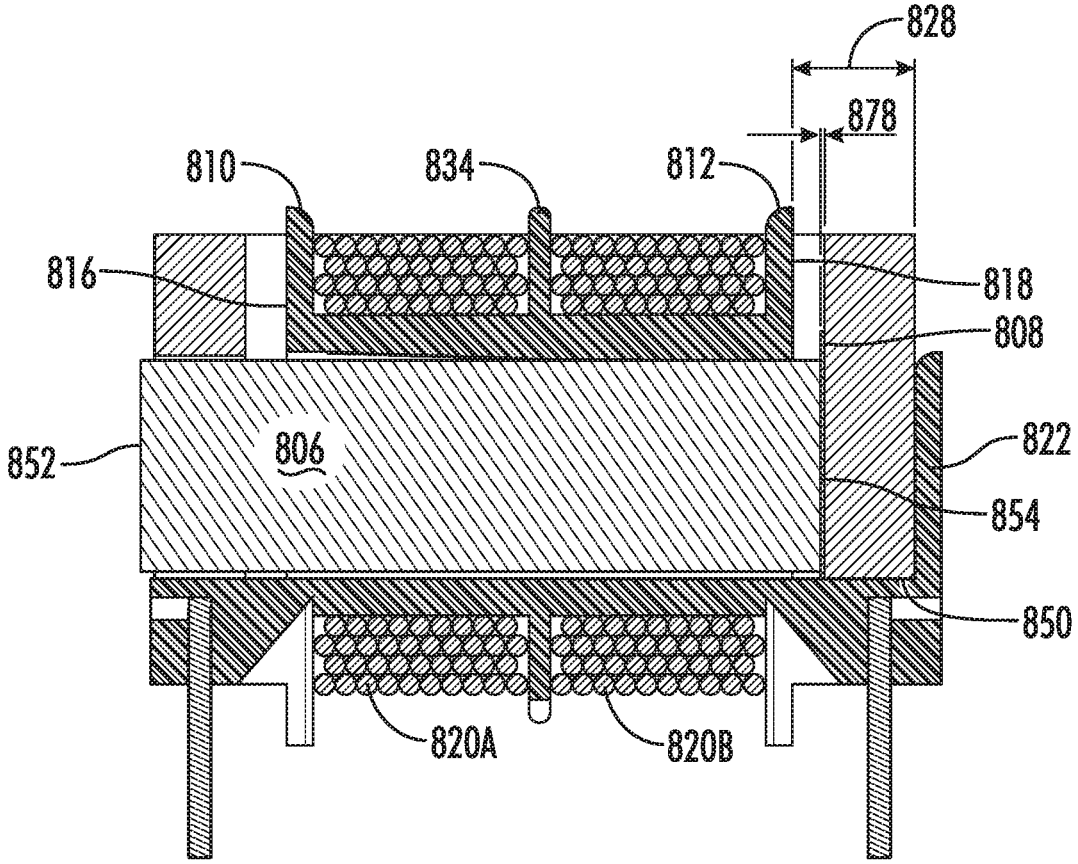
FIG. 11 illustrates a cross-sectional right side elevational view of the assembly of FIG. 8.

As shown in FIG. 9, the bobbin 802 of the magnetic assembly 800 includes a first outer flange 810, a second outer flange 812, and a passageway 814. The passageway 814 of the bobbin 802 is configured to extend through the bobbin 802 from a first outer flange outer surface 816 to a second outer flange outer surface 818 (FIGS. 10 and 11). The bobbin 802 further includes at least one winding wound about the passageway 814 between the first outer flange 810 and the second outer flange 812. In the illustrated second embodiment, the at least one winding comprises a first winding 820A and a second winding 820B.

In the second embodiment, the bobbin 802 further includes a channel wall 822. The channel wall 822 extends vertically from a pin rail 824 attached to the second outer flange outer surface 818. The channel wall 822 is parallel to the second outer flange outer surface 818. The channel wall 822 has an inner channel wall surface 826. The inner channel wall surface 826 is spaced apart from the second outer flange outer surface 818 by a channel distance 828 (FIG. 10). The channel distance 828 defines a channel 830 (FIG. 9) between the inner channel wall surface 826 and the second outer flange outer surface 818. In an alternative embodiment, the bobbin 802 includes at least one crushable flange rib (not shown) to position the outer core 804 with respect to the bobbin 802.

Figure 12:
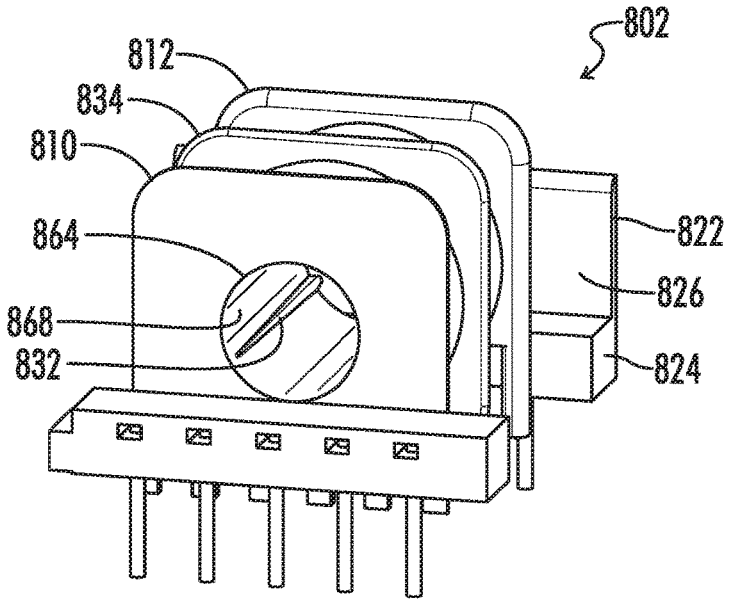
FIG. 12 illustrates a perspective view of the bobbin of FIG. 9.
Figure 13:
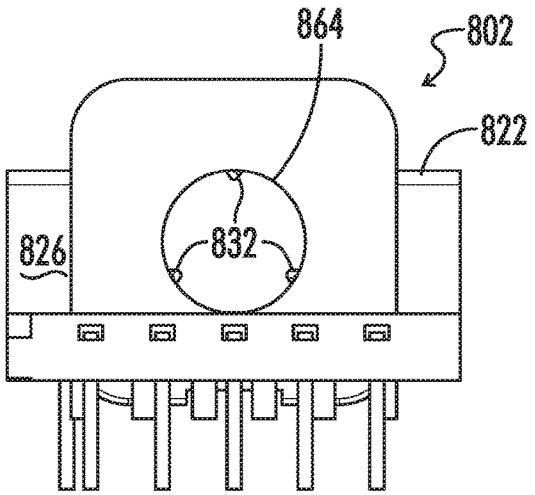
FIG. 13 illustrates a front elevational view of the front of the bobbin of FIG. 9.
Figure 14:
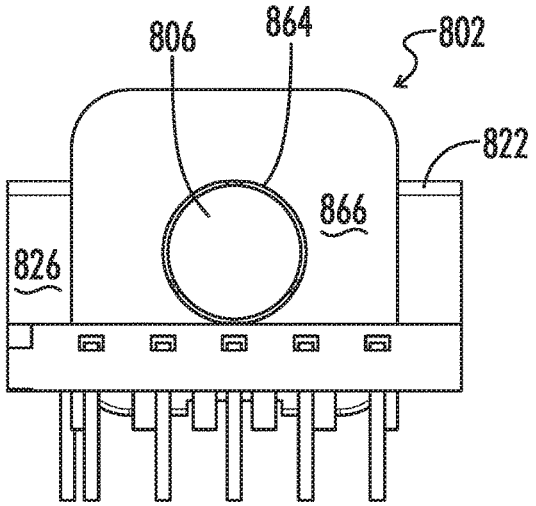
FIG. 14 illustrates the front elevational view of the bobbin of FIG. 9 with the center core inserted in the passageway of the bobbin.

As shown in FIGS. 12-14, the bobbin 802 includes at least one crushable passageway rib 832 protruding into the passageway 814.

The bobbin 802 includes at least one intermediate flange 834. The at least one intermediate flange 834 is positioned between the first outer flange 810 and the second outer flange 812. The at least one intermediate flange 834 separates the first winding 820A and the second winding 820B. The first winding 820A is positioned between the first outer flange 810 and the at least one intermediate flange 834. The second winding 820B is positioned between the second outer flange 812 and the at least one intermediate flange 834.

In the second embodiment, the outer core 804 of the magnetic component 800 is configured to be positioned around the first outer flange 810 and the second outer flange 812. The outer core 804 is one continuous piece. Because the outer core 804 is one continuous piece, no stray fields are created by the outer core 104, which causes the magnetic assembly 800 to be more efficient. The outer core 804 has a first end wall 840. The first end wall 840 has a first inner surface 842, as shown in FIGS. 10 and 11. The first inner surface 842 is configured to be positioned adjacent to the first outer flange 810. The outer core 804 further has a second end wall 844. The second end wall 844 has a second inner surface 846. The second inner surface 846 is configured to be positioned adjacent to the second outer flange 812. The first end wall 840 further includes an opening 848. The opening 848 is configured to align with the passageway 814. In the illustrated embodiment, the outer core 804 comprises a ferrite material.

As shown in FIG. 9, the opening 848 of the outer core 804 is configured to extend to a lower surface 850 of the outer core 804. In certain embodiments (not shown), the opening 848 of the outer core 804 does not extend to the lower surface 850.

In the second embodiment, the inner core 806 of the magnetic assembly 800 is configured to be positioned through the passageway 814 of the bobbin 802. The inner core 806 has a first end surface 852, a second end surface 854, and an outer surface 856. The outer surface 856 of the inner core 806 spans between the first end surface 852 and the second end surface 854 of the inner core 806. The first end surface 852 of the inner core 806 extends past the first outer flange 810 of the bobbin 802. The first end surface 852 of the inner core 806 is accessible through the opening 848 in the first end wall 840 of the outer core 804 when the outer core 804 is positioned on the bobbin 802. The opening 848 of the outer core 804 provides access to the inner core 806. The second end surface 854 of the inner core 806 is configured to be positioned adjacent to the second outer flange 812 of the bobbin 802. In the illustrated embodiment, the inner core 806 comprises a ferrite material.

As shown in FIG. 14, the inner core 806 is positioned in frictional engagement with the at least one crushable passageway rib 832. The at least one crushable passageway rib 832 is shown uncrushed in FIG. 13 and is shown crushed in FIG. 14.

As shown in FIGS. 10 and 11, the second end wall 844 of the outer core 804 is configured to be received in the channel 830. The second end wall 844 of the outer core 804 is secured to the bobbin 802 by frictional engagement between the second end surface 854 of the inner core 806 and the inner channel wall surface 826 of the channel wall 822.

Figure 8:
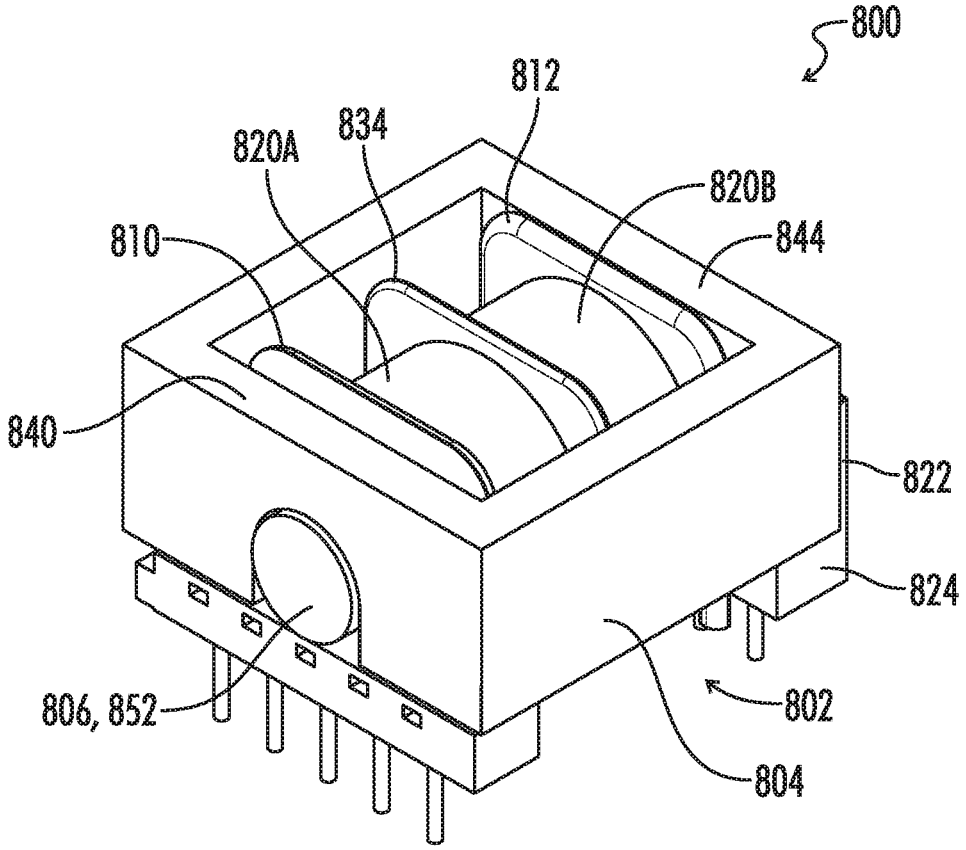
FIG. 8 illustrates a perspective view of a multi-winding magnetic assembly with a cylindrical center leg in accordance with the present disclosure.

The passageway 814 of the bobbin 802 has a circular cross-sectional passageway profile 864, as shown in FIGS. 12-14. As shown in FIG. 14, the inner core 806 has a circular cross-sectional inner core profile 866 configured to fit within the circular cross-sectional passageway profile 864. As shown in FIGS. 12 and 13, the at least one crushable passageway rib 832 includes at least three ribs positioned around an inside surface 868 (FIGS. 9 and 12) of the passageway and configured to center the inner core within the passageway. As shown in FIGS. 8 and 9, the opening 848 of the outer core 804 has a semi-circular top opening profile 870 and a rectangular lower opening profile 872. The semi-circular top opening profile 870 includes a flat edge 874. The flat edge 874 of the semi-circular top opening profile 870 is connected and open to the rectangular lower opening profile 872. The rectangular lower opening profile 872 is open to the lower surface 850 of the outer core 104. The opening 848 having the semi-circular top opening profile 870 and the rectangular lower opening profile 872 is configured to fit over or receive the inner core 106. In other embodiments, the opening 848 may have a circular profile, not shown, configured such that the outer core 804 must be positioned prior to placement of the inner core 806 within the passageway 814.

As shown in FIG. 9, the gap spacer 808 of the magnetic assembly 800 is configured to be positioned between the second end surface 854 of the inner core 806 and the second inner surface 846 of the outer core 804. The gap spacer has a thickness 876. The gap spacer is configured to define a gap distance 878 (FIGS. 10 and 11) between the second end surface 854 of the inner core 806 and the second inner surface 846 of the outer core 804. The gap distance 878 is defined even if only part of the gap spacer 808 covers the second end surface 854 of the inner core 806. The gap spacer 808 is secured to the magnetic assembly 800 through frictional engagement between the second end surface 854 of the inner core 806 and the second inner surface 846 of the outer core 804. The gap distance 878 is adjustable. The gap distance 878 may be adjusted by selecting the thickness 876 of the gap spacer. The gap spacer 808 may comprise tape, paper, or any other suitable material.

In certain embodiments (not shown), the gap distance 878 may be adjusted by using multiple gap spacers.

As shown in FIG. 10, the gap spacer 808 is positioned outside of a winding area 880. The winding area 880 is defined between the first outer flange 810 and the second outer flange 812. The first and second windings 820A, 820B are wound onto the winding area 880. Because the gap spacer 808 is positioned outside of the winding area, the stray fields (not shown) produced by the gap do not create unwanted winding losses.

The magnetic assembly 800 is assembled by providing the bobbin 802 having the first outer flange 810, the second outer flange 812, the passageway 814, the at least one winding 820A, 820B, the channel wall 822, and the at least one crushable passageway rib 832. The outer core 804 is then positioned around the first and second outer flanges 810, 814 of the bobbin 802. The gap spacer 808 is then positioned between the second outer flange 814 and the second inner surface 846 of the outer core 804. The inner core 806 is then positioned into the passageway 814 of the bobbin 802. The steps of positioning the outer core 804, gap spacer 808, and inner core 806 may be done in any order. The inner core 806 is then slid within the passageway 814 toward the channel wall 822 until the second end wall 844 of the outer core 804 and the gap spacer 808 are frictionally engaged between the second end surface 854 of the inner core 806 and the inner channel wall surface 826.

In certain embodiments (not shown), the gap distance 878 may be increased in order to decrease the inductance. In other embodiments (not shown), the gap distance 878 may be decreased in order to increase the inductance. The gap distance 878 may be adjusted by using a thicker or thinner gap spacer 808 or by selectively increasing or decreasing the number of gap spacers 808.

The frictional engagement between the bobbin 802, outer core 804, inner core 806, and gap spacer 808 eliminates the need to glue or tape the cores and/or magnetic assembly 800 together.

Particular embodiments of the present invention of a new and useful MAGNETIC CORE STRUCTURE are described herein; however, such references are not to be construed as limitations upon the scope of this invention except as set forth in the following claims.

What is claimed is:

1. A magnetic assembly comprising:

a bobbin comprising a first outer flange, a second outer flange, a passageway extending through the bobbin from a first outer flange outer surface to a second outer flange outer surface, and at least one winding wound about the passageway between the first outer flange and the second outer flange;

an outer core configured to be positioned around the first outer flange and the second outer flange, the outer core having a first end wall having a first inner surface configured to be positioned adjacent to the first outer flange, the outer core having a second end wall having a second inner surface configured to be positioned adjacent the second outer flange, the first end wall further including an opening configured to be positioned in alignment with the passageway;

an inner core configured to be positioned through the passageway of the bobbin, the inner core having a first end surface, a second end surface, and an outer surface, the outer surface of the inner core spanning between the first end surface and the second end surface of the inner core, the first end surface of the inner core extending past the first outer flange of the bobbin and accessible through the opening in the first end wall of the outer core, the second end surface of the inner core configured to be positioned adjacent to the second outer flange of the bobbin; and a non-magnetic gap spacer having a first spacer surface and a second spacer surface, the gap spacer positioned between the second end surface of the inner core and the second inner surface of the outer core, the gap spacer defining a gap distance, the gap spacer secured between the second end surface of the inner core and the second inner surface of the outer core only through frictional engagement of the first spacer surface with the second end surface of the inner core and frictional engagement of the second spacer surface with the second inner surface of the outer core.

2. The magnetic assembly of claim 1, further comprising a channel wall extending parallel to a second outer flange outer surface, the channel wall having an inner channel wall surface, the inner channel wall surface spaced apart from the second outer flange outer surface by a channel distance that defines a channel between the second outer flange outer surface and the inner channel wall surface, the second end wall of the outer core secured by frictional engagement between the second end surface of the inner core and the inner channel wall surface.

3. The magnetic assembly of claim 1, wherein the bobbin further includes at least one crushable passageway rib protruding into the passageway.

4. The magnetic assembly of claim 3, wherein the inner core is positioned in frictional engagement with the at least one crushable passageway rib.

5. The magnetic assembly of claim 1, wherein the gap distance is adjustable by selecting a thickness of the gap spacer.

6. The magnetic assembly of claim 1, wherein the gap spacer comprises tape or paper.

7. The magnetic assembly of claim 1, wherein the opening of the outer core is configured to extend to a lower surface of the outer core.

8. The magnetic assembly of claim 1, wherein the passageway of the bobbin has a rectangular cross-sectional passageway profile having four sides, and wherein the inner core has a rectangular cross-sectional inner core profile configured to fit within the passageway.

9. The magnetic assembly of claim 8, wherein the bobbin further includes at least four crushable passageway ribs protruding into the passageway with at least a respective one of the ribs extending into the passageway from a respective one of the four sides of the passageway.

10. The magnetic assembly of claim 8, wherein the opening of the outer core has a rectangular opening profile configured to receive the rectangular cross-sectional inner core profile.

11. The magnetic assembly of claim 1, wherein the passageway of the bobbin has a circular cross-sectional profile, and wherein the inner core has a circular cross-sectional profile configured to fit within the passageway.

12. The magnetic assembly of claim 11, wherein the bobbin further includes at least three crushable passageway ribs protruding into the passageway, the at least three crushable passageway ribs configured to center the inner core within the passageway.

13. The magnetic assembly of claim 11, wherein the opening of the outer core has a semicircular top profile and a rectangular lower profile.

14. The magnetic assembly of claim 1, wherein the bobbin further comprises at least one intermediate flange positioned between the first outer flange and the second outer flange.

15. The magnetic assembly of claim 14, wherein the at least one winding includes a first winding and a second winding, the first winding positioned between the first outer flange and the at least one intermediate flange, and the second winding positioned between the second outer flange and the at least one intermediate flange.

* * * * *